US005799708A

United States Patent [19]

Josef

[11] Patent Number: 5,799,708

[45] Date of Patent: Sep. 1, 1998

[54] PAPERMAKER'S FABRIC HAVING PAIRED IDENTICAL MACHINE-DIRECTION YARNS WEAVING AS ONE

[75] Inventor: Michael J. Josef, Greenville, S.C.

[73] Assignee: Albany International Corp., Albany, N.Y.

[21] Appl. No.: 729,166

[22] Filed: Oct. 11, 1996

[51] Int. Cl.[6] ..... D03D 13/00; D03D 15/00

[52] U.S. Cl. ..... 139/383 AA; 442/199; 442/203; 428/36.1; 428/57

[58] Field of Search ..... 139/383 A, 383 AA; 442/203, 199; 428/57, 36.1

[56] References Cited

U.S. PATENT DOCUMENTS

| | | | |
|---|---|---|---|
| 2,269,869 | 1/1942 | Specht . | |
| 4,123,022 | 10/1978 | Dutt et al. | 139/383 AA |
| 4,574,435 | 3/1986 | Luciano et al. | 139/383 AA |
| 4,636,426 | 1/1987 | Fleischer et al. | 428/224 |
| 4,829,681 | 5/1989 | Josef | 139/383 A |
| 4,934,414 | 6/1990 | Borelo | 139/383 A |
| 5,114,777 | 5/1992 | Gaisser | 139/383 A |
| 5,458,161 | 10/1995 | Scarfe | 139/383 AA |
| 5,465,764 | 11/1995 | Eschmann et al. | 139/383 A |
| 5,473,981 | 12/1995 | Mazaki | 139/383 A |
| 5,514,438 | 5/1996 | Crook, Jr. | 139/383 AA |
| 5,609,931 | 3/1997 | Delavallade | 428/36.1 |
| 5,613,527 | 3/1997 | Zimmermann et al. | 139/383 A |

FOREIGN PATENT DOCUMENTS

| | | | |
|---|---|---|---|
| 1357305 | 5/1963 | France | 139/425 A |
| 454092 | 12/1927 | Germany | 139/383 A |
| 29 07 488 | 8/1980 | Germany | 139/425 A |
| 458363 | 12/1935 | United Kingdom | 139/325 A |

*Primary Examiner*—Andy Falik

*Attorney, Agent, or Firm*—Kane, Dalsimer, Sullivan, Kurucz, Levy, Eisele and Richard, LLP

[57] ABSTRACT

A papermaker's fabric includes a system of machine-direction (MD) yarns interwoven with a system of cross-machine direction (CD) yarns. The MD yarns are pairs of a first MD yarn and a second MD yarn. The first and second MD yarns are of a substantially rectangular cross section having identical width and thickness. The first and second MD yarns of each pair weave side-by-side as a single yarn with the CD yarns through the fabric. The CD yarns are of circular cross section. The fabric has a permeability to air less than 150 cubic feet per minute per square foot at 0.5 inch $H_2O$-pressure.

6 Claims, 3 Drawing Sheets

PAPERMAKER'S FABRIC HAVING PAIRED IDENTICAL MACHINE-DIRECTION YARNS WEAVING AS ONE

BACKGROUND OF THE INVENTION

1. Field of the Invention

The present invention relates to the papermaking arts. More specifically, the present invention is a papermaker's fabric for use on the dryer section of the papermachine, such a fabric being commonly referred to as a dryer fabric.

2. Description of the Prior Art

During the papermaking process, a fibrous web is formed by depositing a fibrous slurry on a forming fabric in the forming section of a papermachine. A large amount of water drains from the slurry through the forming fabric during this process, leaving the fibrous web on the surface of the forming fabric.

The newly formed web proceeds from the forming section to a press section, which includes a series of press nips. The fibrous web passes through the press nips supported between two such press fabrics. In the press nips, the fibrous web is subjected to compressive forces which squeeze water therefrom. This water is accepted by the press fabric or fabrics, and, ideally, does not return to the web.

The web finally proceeds to the dryer section, which includes at least one series of rotatable dryer drums or cylinders, heated from within by steam. The web is directed in a sinuous path sequentially around each in the series of drums by one or more dryer fabrics, which hold the web closely against the surfaces of the drums. The heated drums reduce the water content of the web to a desirable level through evaporation.

The surface characteristics of the fabrics used in the forming and press sections of the papermachine have a direct bearing on the surface properties of the paper being produced. This is also true in the dryer section, where, as stated above, the dryer fabric holds the web closely against the surfaces of the heated dryer cylinders. To promote drying efficiency by increasing the surface area of the dryer fabric directly in contact with the web, and to reduce the marking of the web by the fabric, the dryer fabrics are typically woven to have surfaces which are as smooth as possible. In recent years, one approach that has been taken to provide dryer fabrics with such surfaces has been to include flat monofilament yarns in their woven structures.

As is well-known, sheet disturbance ("flutter") at elevated machine speeds may be reduced by decreasing the permeability of the dryer fabric. Permeability may be decreased by crowding the yarns more closely to one another during the weaving of the fabric, or by including stuffer yarns or other materials in the weave structure to block the flow of air therethrough.

Where flat monofilament yarns are included in as dryer fabric, however, the decrease in permeability achieved by crowding the yarns more closely to one another in the weave structure may be accompanied by an increased susceptibility to wrinkling both during in-house processing and after installation on the dryer section of a papermachine. This is particularly the case where flat monofilament yarns are next, or contiguous, to one another on the surface of the dryer fabric.

The present invention is a dryer fabric which includes flat monofilament yarns, but which is woven in a manner that leaves it less susceptible to the above-noted deficiencies of prior-art fabrics.

SUMMARY OF THE INVENTION

Accordingly, the present invention is a dryer fabric, although it may find application in any of the forming, press and dryer sections of a papermachine.

As such, the present invention is a papermaker's fabric for the forming, press and dryer sections of a papermachine. The fabric includes a system of machine-direction (MD) yarns interwoven with a system of cross-machine direction (CD) yarns.

The MD yarns comprise pairs of a first MD yarn and a second MD yarn. The first and second MD yarns of each pair weave side-by-side one another as a single yarn through the fabric, and are identical to one another in cross-sectional geometry and area.

The fabric is preferably of a single-layer weave, such as a plain weave.

The first and second MD yarns of each pair have identical cross-sectional geometries. Preferably, the geometries are rectangular, or substantially rectangular as the corners are inevitably rounded to some extent. Alternatively, the cross-sectional geometries may be circular, oval or multi-lobed.

The CD yarns may be of a circular cross section.

One of the first and second MD yarns in each pair may form a seaming loop at a widthwise edge of the fabric so that it may be joined into endless form with a pin seam.

Alternatively, one of the first and second MD yarns in each pair may be woven around seaming spirals at the widthwise edges of the fabric to connect the seaming spirals thereto, so that the fabric may be joined into endless form with an in-line spiral seam.

In addition, the first MD yarns may be of one polymeric resin material, and the second MD yarns may be of another different polymeric resin material, so that the MD yarns, that is, the first and second MD yarns taken together, may have the desirable characteristics of both polymeric resin materials.

The present invention will now be described in more complete detail, with frequent reference being made to the drawing figures identified below.

DETAILED DESCRIPTION OF THE PREFERRED EMBODIMENTS

Figure 1:
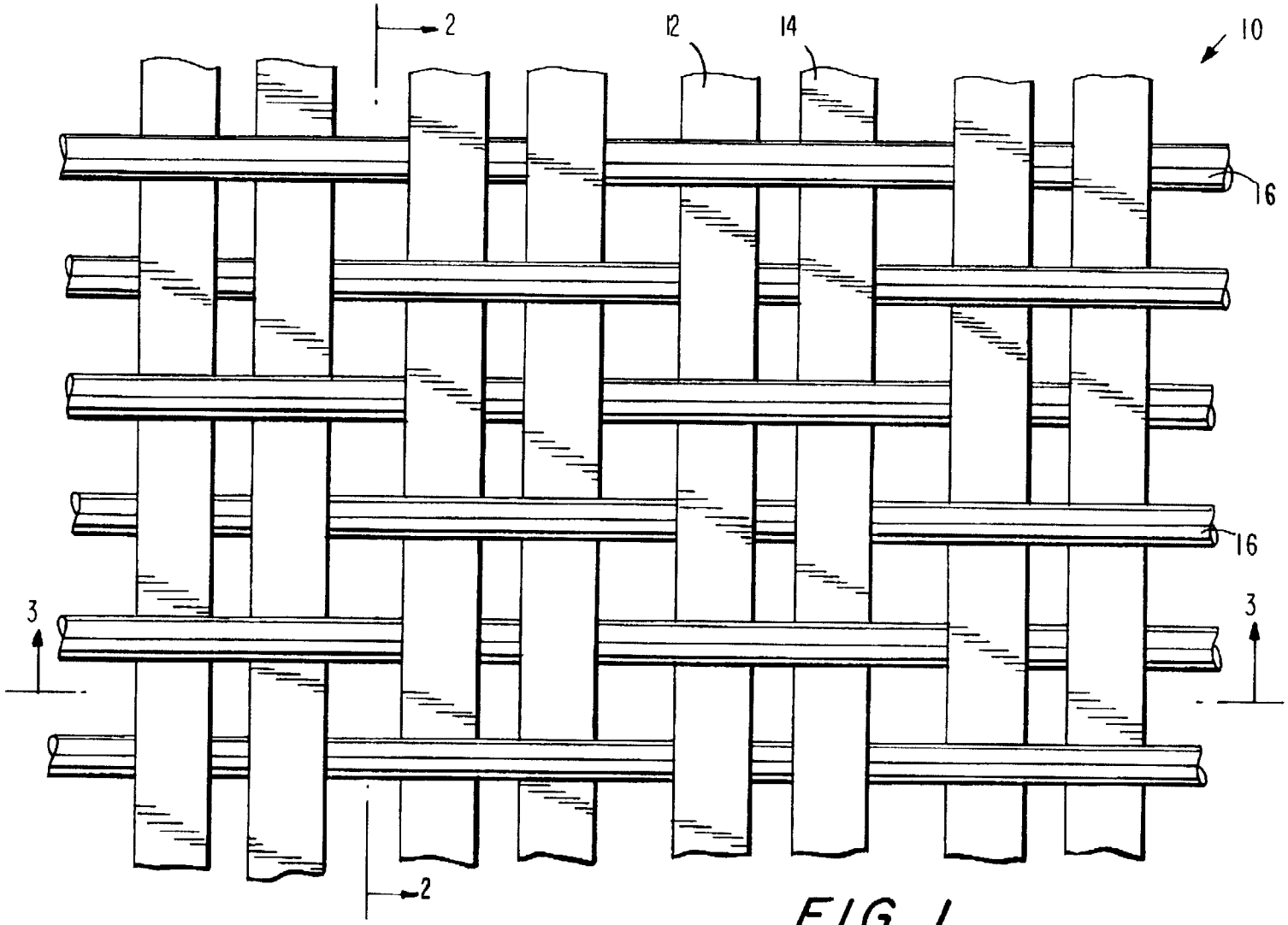
FIG. 1 is a plan view of the upper surface of the papermaker's fabric of the present invention.

With reference now to the figures, FIG. 1 is a plan view of the upper surface of the papermaker's fabric 10 of the present invention. In FIG. 1, the machine direction (MD) and cross-machine direction (CD) are as indicated. While only the upper surface is visible, it will be apparent to the reader from the description to follow that the lower surface has a similar appearance. The spacing between the yarns of the papermaker's fabric 10 in this and other figures is greatly exaggerated for the sake of clarity. In fact, the yarns are woven rather tightly to provide papermaker's fabric 10 with a permeability to air of less than 150 cubic feet per minute per square foot at 0.5 inch $H_2O$-pressure.

Papermaker's fabric 10 is preferably woven in a single-layer weave, and is so represented in the several drawing figures. A plain weave is a preferred single-layer weave, although, depending upon the application, a twill or satin weave may be used.

Papermaker's fabric 10 comprises machine-direction (MD) yarns 12, 14 interwoven with cross-machine direction (CD) yarns 16. MD yarns 12, 14 weave with CD yarns 16 together side-by-side through the fabric 10. That is to say, more particularly, MD yarns 12, 14 weave as one yarn with CD yarns 16.

MD yarns 12, 14 are identical to one another in cross-sectional shape and size, and perhaps also in composition. One of the MD yarns 12, 14 may be used to form seaming loops at the two widthwise edges of the fabric 10 to join it into endless form upon installation on the dryer section of a papermachine with a pin seam. That is, MD yarns 12 or MD yarns 14 are used to form the seaming loops.

Alternatively, one of the MD yarns 12, 14 may be used to connect seaming spirals to the two widthwise edges of the fabric 10, so that the fabric 10 may be joined into endless form with an in-line spiral seam.

MD yarns 12, 14, as indicated above, weave side-by-side, as one, for the length of the fabric 10. Although fabric 10 has been depicted exaggeratedly open in FIG. 1, MD yarns 12, 14 in each pair thereof actually abut against one another for the length of the fabric 10. A consequence of this paired, side-by-side relationship between MD yarns 12, 14 is the elimination of one half of the holes through the fabric 10 providing it with a desired reduction in permeability to air.

Figure 2:
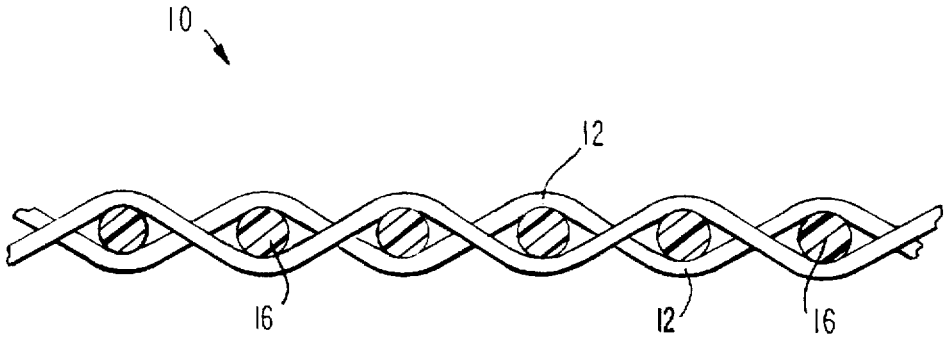
FIG. 2 is a cross-sectional view, taken as indicated by line 2—2 in FIG. 1, of the papermaker's fabric.

FIG. 2 is a cross-sectional view taken as indicated by line 2—2 in FIG. 1. MD yarns 12 are depicted as weaving with CD yarns 16 in a single-layer plain weave. MD yarns 14 are hidden behind the MD yarns 12 with which they are paired in the view given in FIG. 2. CD yarns 16 are of circular cross section.

Figure 3:
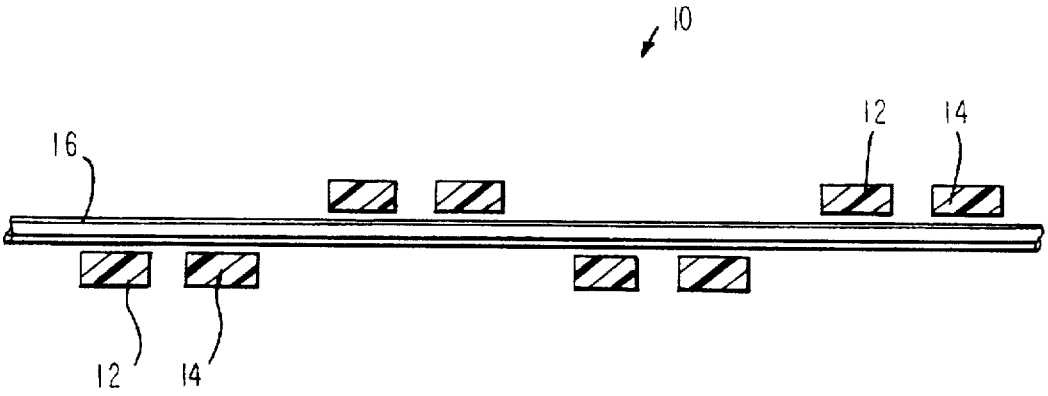
FIG. 3 is a cross-sectional view, taken as indicated by line 3—3 in FIG. 1.

FIG. 3 is a cross-sectional view taken as indicated by line 3—3 in FIG. 1. MD yarns 12, 14 preferably have rectangular cross sections. In practice, the cross-sections would not have the sharp corners illustrated; in fact, the corners would tend to be slightly rounded, a consequence of the material of MD yarns 12, 14 remaining liquid for a short interval following their extrusion through a die having a rectangular opening. MD yarns 12 have the same thickness and width as MD yarns 14. Alternatively, MD yarns 12, 14 may be of circular, oval or multi-lobed cross-sectional shape, so long as MD yarns 12, 14 are identical to one another.

Figure 4:
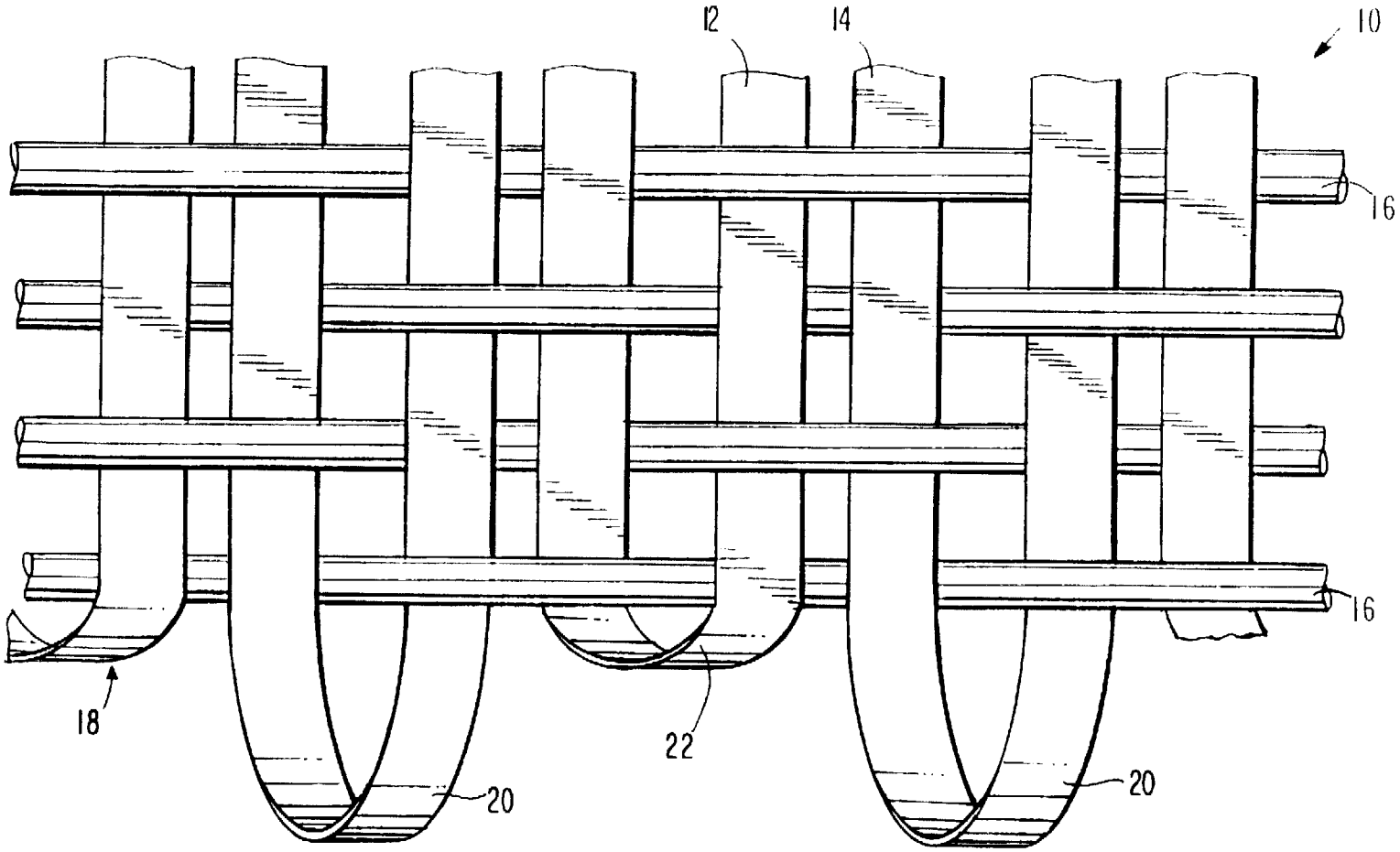
FIG. 4 is a plan view of one of the two widthwise edges of the papermaker's fabric.

FIG. 4 is a plan view of one of the two widthwise edges of the papermaker's fabric 10. At the widthwise edge 18 shown, one of the MD yarns 12,14 of each pair forms a seaming loop 20. The other of the MD yarns 12,14 of each pair weaves around the CD yarn 16 closest to the widthwise edge 18 and back into the papermaker's fabric 10 at point 22 without forming a seaming loop 20. Similar means for providing seaming loops at the widthwise edges of a papermaker's fabric are shown in U.S. Pat. No. 4,026,331 to Lees et al. and U.S. Pat. No. 5,188,884 to Smith.

MD yarns 12, 14 and CD yarns 16 may be monofilament yarns of any of the synthetic polymeric resins used in the production of such yarns for papermachine clothing. Polyester and polyamide are but two examples of such materials. Other examples of such materials are yarns of polyphenylene sulfide (PPS), which is commercially available under the name RYTON®, and yarns of a modified heat-, hydrolysis- and contaminant-resistant polyester of the variety disclosed in commonly assigned U.S. Pat. No. 5,169,499, and used in dryer fabrics sold by Albany International Corp. under the trademark THERMONETICS®. The teachings of U.S. Pat. No. 5,169,499 are incorporated herein by reference.

MD yarns 12, 14 of two different polymeric resin materials may be used because no single polymer can provide all of the characteristics required of an MD yarn in a dryer fabric: strength, abrasion resistance, hydrolysis resistance and flex resistance. As such, it may be desirable to provide MD yarns 12 of one polymer and MD yarns 14 of another polymer, so that the two yarns, MD yarns 12, 14, can have all of the desirable properties of both polymers.

As a general example of the present invention, MD yarns 12, 14 may be of rectangular cross section having a width of 0.88 mm and a thickness of 0.44 mm. MD yarns 12, 14 would then each have an aspect ratio (width/thickness) of 2:1, and weave together side-by-side as a single MD yarn having a width of 1.76 mm (0.88 mm+0.88 mm) and a thickness of 0.44 mm. This technique effectively reduces the number of holes through the fabric by half, thereby reducing its air permeability.

A single-layer plain-weave fabric, having 28 MD ends/inch, counting both MD yarns 12 and MD yarns 14, and 13 CD ends/inch, produced in accordance with the present invention has a permeability below 150 cubic feet per minute per square foot at 0.5 inch $H_2O$-pressure. Only one of MD yarns 12, 14 may be used to form seam loops at the widthwise edges of the fabric, or to connect seaming spirals thereto. In contrast, it would be very difficult to form a seam loop by twisting a single yarn having a width of 1.76 mm and a thickness of 0.44 mm, and an aspect ratio of 4:1 .

Dryer fabrics of the prior art typically have from 40 to 55 CD ends/inch, many of them bulky stuffer yarns, to reduce their permeabilities to air. This practice requires the inclusion of more yarn material in the fabrics, and increases the material costs for each fabric. In addition, the more CD ends/inch, the more time is required to weave a given dryer fabric at additional cost. The present dryer fabrics require less yarn material, fewer CD ends/inch and are woven in a shorter period of time, yet have very low permeabilities to air.

Modifications to the above would be obvious to those of ordinary skill in the art, but would not bring the invention so modified beyond the scope of the appended claims.

What is claimed is:

1. A papermaker's fabric for the forming, press and dryer sections of a papermachine comprising:

a system of machine-direction (MD) yarns interwoven with a system of cross-machine direction (CD) yarns, said MD yarns comprising pairs of a first MD yarn and a second MD yarn, said first and second MD yarns of each said pair having a substantially rectangular cross section and weaving side-by-side as a single yarn with said CD yarns through said fabric and having identical cross-sectional geometries, said MD yarns being interwoven with said CD yarns in a tight weave to provide said papermaker's fabric with a permeability to air of less than 150 cubic feet per minute per square foot at 0.5 inch $H_2O$-pressure, wherein only one of said first and second MD yarns of said pairs forms seaming loops at widthwise edges of said fabric for use in joining said fabric into endless form during installation on a papermachine.

2. A papermaker's fabric as claimed in claim 1 wherein said system of MD yarns is interwoven with said system of CD yarns in a single-layer weave.

3. A papermaker's fabric as claimed in claim 2 wherein said single-layer weave is a weave selected from the group consisting of plain, twill and satin weaves.

4. A papermaker's fabric as claimed in claim 1 wherein said CD yarns have a circular cross section.

5. A papermaker's fabric as claimed in claim 1 wherein said first MD yarn in each pair is of a first polymeric resin material and said second MD yarn in each pair is of a second polymeric resin material different from said first polymeric resin material.

6. A papermaker's fabric as claimed in claim 1 wherein said first MD yarn in each pair is of a first polymeric resin material and said second MD yarn in each pair is of a second polymeric resin material identical to said first polymeric resin material.

* * * * *